US012082604B2

(12) United States Patent
Sutton et al.

(10) Patent No.: US 12,082,604 B2
(45) Date of Patent: Sep. 10, 2024

(54) ARTICLE FOR USE WITH APPARATUS FOR HEATING SMOKABLE MATERIAL

(71) Applicant: Nicoventures Trading Limited, London (GB)

(72) Inventors: Joseph Sutton, London (GB); Dominic Woodcock, London (GB); Darren Seymour, London (GB); Hitesh Vallabh, London (GB); Neil Litten, London (GB); Harpal Singh, London (GB); David Russell, London (GB); Ahmad Bitar, London (GB)

(73) Assignee: NICOVENTURES TRADING LIMITED, London (GB)

( * ) Notice: Subject to any disclaimer, the term of this patent is extended or adjusted under 35 U.S.C. 154(b) by 36 days.

(21) Appl. No.: 17/846,264

(22) Filed: Jun. 22, 2022

(65) Prior Publication Data

US 2022/0312828 A1 Oct. 6, 2022

Related U.S. Application Data

(62) Division of application No. 15/563,086, filed as application No. PCT/EP2016/057064 on Mar. 31, 2016, now abandoned.

(30) Foreign Application Priority Data

Mar. 31, 2015 (GB) ..... 1505597

(51) Int. Cl.
*A24B 15/167* (2020.01)
*A24F 40/42* (2020.01)
*A24F 40/20* (2020.01)

(52) U.S. Cl.
CPC ..... *A24B 15/167* (2016.11); *A24F 40/42* (2020.01); *A24F 40/20* (2020.01)

(58) Field of Classification Search
CPC ..... A24F 40/20; A24F 40/42; A24B 15/167
See application file for complete search history.

(56) References Cited

U.S. PATENT DOCUMENTS 2,057,353 A 10/1936 Whittemore
2,809,634 A 10/1957 Hirotada et al.
(Continued)

FOREIGN PATENT DOCUMENTS

AT 508244 A4 12/2010
AU 6393173 A 6/1975
(Continued)

OTHER PUBLICATIONS

CN-204120237-U (Machine Translation) [online], [retrieved on Sep. 20, 2023], retrieved from Espacenet (https://worldwide.espacenet.com/) (Year: 2015).*

(Continued)

*Primary Examiner* — Philip Y Louie
*Assistant Examiner* — Yana B Krinker
(74) *Attorney, Agent, or Firm* — Husch Blackwell

(57) ABSTRACT

An article is provided for use with an apparatus for heating smokable material to volatilize at least one component of the smokable material. The article has a carrier and smokable material arranged on the carrier. The smokable material has a first layer of smokable material and a second layer of smokable material. The first layer of smokable material is located between the carrier and the second layer of smokable material. The smokable material of the first layer of smokable material has a form or chemical composition that differs from the form or chemical composition, respectively, of the smokable material of the second layer of smokable material.

6 Claims, 6 Drawing Sheets

(56) References Cited

U.S. PATENT DOCUMENTS 2,937,648 A 5/1960 Meyer
2,991,788 A 7/1961 Brost
3,111,396 A 11/1963 Ball
3,148,996 A 9/1964 Vukasovich et al.
3,239,117 A 3/1966 Letchworth
3,402,724 A 9/1968 Blount et al.
3,431,393 A 3/1969 Katsuda et al.
3,433,632 A 3/1969 Elbert et al.
3,521,643 A 7/1970 Toth et al.
3,604,428 A 9/1971 Moukaddem
3,804,100 A 4/1974 Fariello
3,844,199 A 10/1974 Block et al.
3,964,902 A 6/1976 Fletcher
4,009,713 A 3/1977 Simmons et al.
4,031,906 A 6/1977 Knapp
4,094,119 A 6/1978 Sullivan
4,145,001 A 3/1979 Weyenberg et al.
4,161,283 A 7/1979 Hyman
4,193,513 A 3/1980 Bull, Jr.
4,219,031 A 8/1980 Rainer et al.
4,503,851 A 3/1985 Braunroth
4,588,976 A 5/1986 Jaselli
4,676,237 A 6/1987 Wood et al.
4,735,217 A 4/1988 Gerth et al.
4,827,950 A 5/1989 Banerjee et al.
4,830,028 A 5/1989 Lawson et al.
4,846,199 A 7/1989 Rose
4,848,374 A 7/1989 Chard et al.
4,885,129 A 12/1989 Leonard et al.
4,917,301 A 4/1990 Munteanu
4,922,901 A 5/1990 Brooks et al.
4,924,886 A 5/1990 Litzinger
4,947,874 A 8/1990 Brooks et al.
4,947,875 A 8/1990 Brooks et al.
4,978,814 A 12/1990 Honour
5,027,837 A 7/1991 Clearman et al.
5,046,514 A 9/1991 Bolt
5,060,671 A 10/1991 Counts et al.
5,065,776 A 11/1991 Lawson et al.
5,095,647 A 3/1992 Zobele et al.
5,095,921 A 3/1992 Losee et al.
5,099,861 A 3/1992 Clearman et al.
5,115,823 A 5/1992 Keritsis
5,121,881 A 6/1992 Lembeck
5,129,409 A 7/1992 White et al.
5,144,962 A 9/1992 Counts et al.
5,167,242 A 12/1992 Turner et al.
5,179,966 A 1/1993 Losee et al.
5,247,947 A 9/1993 Clearman et al.
5,322,075 A 6/1994 Deevi et al.
5,369,723 A * 11/1994 Counts ..... A24D 1/20 131/194
5,388,574 A 2/1995 Ingebrethsen
5,390,864 A 2/1995 Alexander
5,415,186 A 5/1995 Casey, III et al.
5,415,486 A 5/1995 Wouters et al.
5,479,948 A 1/1996 Counts et al.
5,497,792 A 3/1996 Prasad et al.
5,501,236 A 3/1996 Hill et al.
5,505,214 A 4/1996 Collins et al.
5,540,241 A 7/1996 Kim
5,553,791 A 9/1996 Alexander
5,611,360 A 3/1997 Tang
5,636,787 A 6/1997 Gowhari
5,649,554 A 7/1997 Sprinkel et al.
5,666,977 A 9/1997 Higgins et al.
5,692,291 A 12/1997 Deevi et al.
5,692,526 A 12/1997 Adams et al.
5,743,251 A 4/1998 Howell et al.
5,865,185 A 2/1999 Collins et al.
5,954,060 A 9/1999 Cardarelli
6,095,505 A 8/2000 Miller
6,155,268 A 12/2000 Takeuchi
6,275,650 B1 8/2001 Lambert
6,280,793 B1 8/2001 Atwell et al.
6,532,965 B1 3/2003 Abhulimen et al.
6,652,804 B1 11/2003 Neumann et al.
6,681,998 B2 1/2004 Sharpe et al.
6,701,921 B2 3/2004 Sprinkel, Jr. et al.
6,790,496 B1 9/2004 Levander et al.
7,100,618 B2 9/2006 Dominguez
7,112,712 B1 9/2006 Ancell
7,263,228 B2 8/2007 Mori
7,400,940 B2 7/2008 McRae et al.
7,540,286 B2 6/2009 Cross et al.
7,767,698 B2 8/2010 Warchol et al.
7,832,410 B2 11/2010 Hon
7,992,554 B2 8/2011 Radomski et al.
8,156,944 B2 4/2012 Han
8,205,622 B2 6/2012 Pan
8,365,742 B2 2/2013 Hon
8,375,957 B2 2/2013 Hon
8,393,331 B2 3/2013 Hon
8,430,106 B2 4/2013 Potter et al.
8,490,628 B2 7/2013 Hon
8,511,318 B2 8/2013 Hon
8,689,805 B2 4/2014 Hon
8,752,545 B2 6/2014 Buchberger
8,833,364 B2 9/2014 Buchberger
8,948,578 B2 2/2015 Buchberger
8,975,764 B1 3/2015 Abehasera
9,623,205 B2 4/2017 Buchberger
9,943,108 B2 4/2018 Lord
9,974,335 B2 5/2018 Lord
10,111,466 B2 10/2018 Lord
10,278,421 B2 5/2019 Lord
10,582,729 B2 3/2020 Lord
10,588,354 B2 3/2020 Lord
2001/0042546 A1 11/2001 Umeda et al.
2002/0016370 A1 2/2002 Shytle et al.
2002/0079309 A1 6/2002 Cox et al.
2003/0005620 A1 1/2003 Ananth et al.
2003/0049025 A1 3/2003 Neumann et al.
2003/0063902 A1 4/2003 Pedrotti et al.
2003/0079309 A1 5/2003 Vandenbelt et al.
2003/0106552 A1 6/2003 Sprinkel, Jr. et al.
2003/0200964 A1 10/2003 Blakley et al.
2004/0031485 A1 2/2004 Rustad et al.
2004/0065749 A1 4/2004 Kotary et al.
2004/0129793 A1 7/2004 Nguyen et al.
2005/0204799 A1 9/2005 Koch
2005/0268911 A1 12/2005 Cross et al.
2006/0078477 A1 4/2006 Althouse et al.
2006/0131439 A1 6/2006 Lakatos et al.
2007/0014549 A1 1/2007 Demarest et al.
2007/0062548 A1 3/2007 Horstmann et al.
2007/0102013 A1 5/2007 Adams et al.
2007/0107879 A1 5/2007 Radomski et al.
2007/0137667 A1 6/2007 Zhuang et al.
2007/0155255 A1 7/2007 Galauner et al.
2007/0283972 A1 12/2007 Monsees et al.
2008/0092912 A1 4/2008 Robinson et al.
2008/0216828 A1 9/2008 Wensley et al.
2008/0241255 A1 10/2008 Rose et al.
2009/0095311 A1 4/2009 Han
2009/0188490 A1 7/2009 Han
2009/0272379 A1 11/2009 Thorens et al.
2009/0288668 A1 11/2009 Inagaki
2009/0293888 A1 12/2009 Williams et al.
2009/0293892 A1 12/2009 Williams et al.
2009/0302019 A1 12/2009 Selenski et al.
2010/0006113 A1 1/2010 Urtsev et al.
2010/0024834 A1 2/2010 Oglesby et al.
2010/0059070 A1 3/2010 Potter et al.
2010/0065653 A1 3/2010 Wingo et al.
2010/0083959 A1 4/2010 Siller
2010/0108059 A1 5/2010 Axelsson et al.
2010/0236546 A1 9/2010 Yamada et al.
2011/0005535 A1 1/2011 Xiu
2011/0011396 A1 1/2011 Fang
2011/0036363 A1 2/2011 Urtsev et al.
2011/0094523 A1 4/2011 Thorens et al.
2011/0126848 A1 6/2011 Zuber et al.
2011/0155153 A1 6/2011 Thorens et al.

(56) References Cited

U.S. PATENT DOCUMENTS

| | | | |
|---|---|---|---|
| 2011/0168194 | A1 | 7/2011 | Hon |
| 2011/0209717 | A1 | 9/2011 | Han |
| 2011/0226236 | A1 | 9/2011 | Buchberger |
| 2011/0232654 | A1 | 9/2011 | Mass |
| 2011/0277756 | A1 | 11/2011 | Terry et al. |
| 2011/0277757 | A1 | 11/2011 | Terry et al. |
| 2011/0290267 | A1 | 12/2011 | Yamada et al. |
| 2011/0297166 | A1 | 12/2011 | Takeuchi et al. |
| 2011/0303231 | A1 | 12/2011 | Li et al. |
| 2012/0006343 | A1 | 1/2012 | Renaud et al. |
| 2012/0111347 | A1 | 5/2012 | Hon |
| 2012/0145169 | A1 | 6/2012 | Wu |
| 2012/0179512 | A1 | 7/2012 | O'Keeffe |
| 2012/0227753 | A1 | 9/2012 | Newton |
| 2012/0234821 | A1 | 9/2012 | Shimizu |
| 2012/0255567 | A1 | 10/2012 | Rose et al. |
| 2012/0260927 | A1 | 10/2012 | Liu |
| 2012/0279512 | A1 | 11/2012 | Hon |
| 2012/0285475 | A1 | 11/2012 | Liu |
| 2012/0285476 | A1 | 11/2012 | Hon |
| 2013/0037041 | A1 | 2/2013 | Worm et al. |
| 2013/0056013 | A1 | 3/2013 | Terry et al. |
| 2013/0074857 | A1 | 3/2013 | Buchberger |
| 2013/0081619 | A1 | 4/2013 | Seakins et al. |
| 2013/0081623 | A1 | 4/2013 | Buchberger |
| 2013/0192615 | A1 | 8/2013 | Tucker et al. |
| 2013/0192623 | A1 | 8/2013 | Tucker et al. |
| 2013/0213417 | A1 | 8/2013 | Chong et al. |
| 2013/0213419 | A1 | 8/2013 | Tucker et al. |
| 2013/0284192 | A1 | 10/2013 | Peleg et al. |
| 2013/0298905 | A1 | 11/2013 | Levin et al. |
| 2013/0306085 | A1 | 11/2013 | Sanchez et al. |
| 2013/0333700 | A1 | 12/2013 | Buchberger |
| 2013/0340779 | A1 | 12/2013 | Liu |
| 2014/0000638 | A1 | 1/2014 | Sebastian et al. |
| 2014/0007863 | A1 | 1/2014 | Chen |
| 2014/0024834 | A1 | 1/2014 | Mergelsberg et al. |
| 2014/0060528 | A1 | 3/2014 | Liu |
| 2014/0060529 | A1 | 3/2014 | Zhang |
| 2014/0060554 | A1 | 3/2014 | Collett et al. |
| 2014/0060555 | A1 | 3/2014 | Chang et al. |
| 2014/0069444 | A1 | 3/2014 | Cyphert et al. |
| 2014/0202454 | A1 | 7/2014 | Buchberger |
| 2014/0209105 | A1 | 7/2014 | Sears et al. |
| 2014/0238396 | A1 | 8/2014 | Buchberger |
| 2014/0238423 | A1 | 8/2014 | Tucker et al. |
| 2014/0238424 | A1 | 8/2014 | Macko et al. |
| 2014/0261490 | A1 | 9/2014 | Kane |
| 2014/0270730 | A1 | 9/2014 | DePiano et al. |
| 2014/0283825 | A1 | 9/2014 | Buchberger |
| 2014/0286630 | A1 | 9/2014 | Buchberger |
| 2014/0299125 | A1 | 10/2014 | Buchberger |
| 2014/0299142 | A1 | 10/2014 | Dincer et al. |
| 2014/0338680 | A1 | 11/2014 | Abramov et al. |
| 2015/0020831 | A1 | 1/2015 | Weigensberg et al. |
| 2015/0114411 | A1 | 4/2015 | Buchberger |
| 2015/0150302 | A1 | 6/2015 | Metrangolo et al. |
| 2015/0157055 | A1 | 6/2015 | Lord |
| 2015/0196058 | A1 | 7/2015 | Lord |
| 2015/0201675 | A1 | 7/2015 | Lord |
| 2015/0208728 | A1 | 7/2015 | Lord |
| 2015/0245654 | A1 | 9/2015 | Memari et al. |
| 2015/0258288 | A1 | 9/2015 | Sullivan |
| 2015/0333552 | A1 | 11/2015 | Alarcon |
| 2015/0333561 | A1 | 11/2015 | Alarcon |
| 2016/0073693 | A1 | 3/2016 | Reevell |
| 2016/0106154 | A1 | 4/2016 | Lord |
| 2016/0106155 | A1 | 4/2016 | Reevell |
| 2016/0250201 | A1 | 9/2016 | Rose et al. |
| 2016/0278436 | A1 | 9/2016 | Verleur et al. |
| 2016/0295923 | A1 | 10/2016 | Lin |
| 2016/0353804 | A1 | 12/2016 | Lord |
| 2017/0042245 | A1 | 2/2017 | Buchberger et al. |
| 2017/0114965 | A1 | 4/2017 | Maglica et al. |
| 2017/0143042 | A1 | 5/2017 | Batista et al. |
| 2017/0173278 | A1 | 6/2017 | Buchberger |
| 2017/0197043 | A1 | 7/2017 | Buchberger |
| 2017/0197044 | A1 | 7/2017 | Buchberger |
| 2017/0197046 | A1 | 7/2017 | Buchberger |
| 2017/0208865 | A1 | 7/2017 | Nettenstrom et al. |
| 2017/0251725 | A1 | 9/2017 | Buchberger et al. |
| 2018/0192705 | A1 | 7/2018 | Lord |
| 2018/0199618 | A1 | 7/2018 | Fuisz et al. |
| 2018/0235284 | A1 | 8/2018 | Lord |
| 2021/0100285 | A1 | 4/2021 | Spencer et al. |

FOREIGN PATENT DOCUMENTS

| | | | | |
|---|---|---|---|---|
| CA | 2309376 | A1 | | 11/2000 |
| CA | 2864238 | A1 | | 8/2013 |
| CH | 698603 | B1 | | 9/2009 |
| CN | 1040496 | A | | 3/1990 |
| CN | 2082939 | U | | 8/1991 |
| CN | 2092880 | U | | 1/1992 |
| CN | 2220168 | Y | | 2/1996 |
| CN | 2249068 | Y | | 3/1997 |
| CN | 1205849 | A | | 1/1999 |
| CN | 2719043 | Y | | 8/2005 |
| CN | 1925757 | A | | 3/2007 |
| CN | 201054977 | Y | | 5/2008 |
| CN | 201079011 | Y | | 7/2008 |
| CN | 101277623 | A | | 10/2008 |
| CN | 201238609 | Y | | 5/2009 |
| CN | 101500443 | A | | 8/2009 |
| CN | 201375023 | Y | | 1/2010 |
| CN | 201379072 | Y | | 1/2010 |
| CN | 201468000 | U | | 5/2010 |
| CN | 101795505 | A | | 8/2010 |
| CN | 101843368 | A | | 9/2010 |
| CN | 101878958 | A | | 11/2010 |
| CN | 202085723 | U | | 12/2011 |
| CN | 202172846 | U | | 3/2012 |
| CN | 102655773 | A | | 9/2012 |
| CN | 202722498 | U | | 2/2013 |
| CN | 202750708 | U | | 2/2013 |
| CN | 103070472 | A | | 5/2013 |
| CN | 203168033 | U | | 9/2013 |
| CN | 103750573 | A | | 4/2014 |
| CN | 103929988 | A | | 7/2014 |
| CN | 103974369 | A | | 8/2014 |
| CN | 103974639 | A | | 8/2014 |
| CN | 104095293 | A | | 10/2014 |
| CN | 203943069 | U | | 11/2014 |
| CN | 204120237 | U | * | 1/2015 |
| CN | 104349687 | A | | 2/2015 |
| CN | 106102863 | A | | 11/2016 |
| DE | 822964 | C | | 11/1951 |
| DE | 1950439 | A1 | | 4/1971 |
| DE | 3148335 | A1 | | 7/1983 |
| DE | 3218760 | A1 | | 12/1983 |
| DE | 3844022 | C1 | | 2/1990 |
| DE | 3936687 | A1 | | 5/1990 |
| DE | 29713866 | U1 | | 10/1997 |
| DE | 19630619 | A1 | | 2/1998 |
| DE | 19654945 | A1 | | 3/1998 |
| DE | 10330681 | B3 | | 6/2004 |
| DE | 202006013439 | U1 | | 10/2006 |
| DE | 102006004484 | A1 | | 8/2007 |
| DE | 102007011120 | A1 | | 9/2008 |
| DE | 202013100606 | U1 | | 2/2013 |
| EA | 015651 | B1 | | 10/2011 |
| EA | 201100197 | A1 | | 3/2012 |
| EP | 0280262 | A2 | | 8/1988 |
| EP | 0295122 | A2 | | 12/1988 |
| EP | 0358002 | A2 | | 3/1990 |
| EP | 0444553 | A2 | | 9/1991 |
| EP | 0488488 | A1 | | 6/1992 |
| EP | 0532194 | A1 | | 3/1993 |
| EP | 0712584 | A2 | | 5/1996 |
| EP | 0845220 | A1 | | 6/1998 |
| EP | 0893071 | A1 | | 1/1999 |
| EP | 1166814 | A2 | | 1/2002 |
| EP | 1166847 | A2 | | 1/2002 |
| EP | 1283062 | A1 | | 2/2003 |

(56) References Cited

FOREIGN PATENT DOCUMENTS

| | | | |
|---|---|---|---|
| EP | 0845220 | B1 | 9/2003 |
| EP | 1486226 | A2 | 12/2004 |
| EP | 1736065 | A1 | 12/2006 |
| EP | 2018886 | A1 | 1/2009 |
| EP | 2022349 | A1 | 2/2009 |
| EP | 1736065 | B1 | 6/2009 |
| EP | 2113178 | A1 | 11/2009 |
| EP | 2119375 | A1 | 11/2009 |
| EP | 2327318 | A1 | 6/2011 |
| EP | 2340729 | A1 | 7/2011 |
| EP | 2394520 | A1 | 12/2011 |
| EP | 2404515 | A1 | 1/2012 |
| EP | 2444112 | A1 | 4/2012 |
| EP | 2444411 | A1 | 4/2012 |
| EP | 2695531 | A1 | 2/2014 |
| EP | 2698070 | A1 | 2/2014 |
| EP | 2762019 | A1 | 8/2014 |
| EP | 2835062 | A1 | 2/2015 |
| EP | 2939553 | A1 | 11/2015 |
| EP | 2083643 | B1 | 9/2017 |
| FR | 960469 | A | 4/1950 |
| GB | 25575 | A | 3/1912 |
| GB | 1313525 | A | 4/1973 |
| GB | 2333466 | A | 7/1999 |
| GB | 2488257 | A | 8/2012 |
| GB | 2496105 | A | 5/2013 |
| HK | 1196511 | A1 | 12/2014 |
| HK | 1226611 | | 10/2017 |
| JP | S5130900 | U | 3/1976 |
| JP | S5752456 | A | 3/1982 |
| JP | S59106340 | A | 6/1984 |
| JP | S6196763 | A | 5/1986 |
| JP | S6196765 | A | 5/1986 |
| JP | H02124081 | A | 5/1990 |
| JP | H0339077 | A | 2/1991 |
| JP | H05103836 | A | 4/1993 |
| JP | H05309136 | A | 11/1993 |
| JP | H06315366 | A | 11/1994 |
| JP | H07502188 | A | 3/1995 |
| JP | H0878142 | A | 3/1996 |
| JP | H08299862 | A | 11/1996 |
| JP | H1189551 | A | 4/1999 |
| JP | H11507234 | A | 6/1999 |
| JP | 2002527153 | A | 8/2002 |
| JP | 3392138 | B2 | 3/2003 |
| JP | 2004332069 | A | 11/2004 |
| JP | 2005537918 | A | 12/2005 |
| JP | 2006504431 | A | 2/2006 |
| JP | 2007259864 | A | 10/2007 |
| JP | 2007267749 | A | 10/2007 |
| JP | 2009502136 | A | 1/2009 |
| JP | 2009504431 | A | 2/2009 |
| JP | 3153675 | U | 9/2009 |
| JP | 2009537119 | A | 10/2009 |
| JP | 2010520742 | A | 6/2010 |
| JP | 3164992 | U | 12/2010 |
| JP | 2011518567 | A | 6/2011 |
| JP | 2012517229 | A | 8/2012 |
| JP | 5130900 | B2 | 1/2013 |
| JP | 2013545473 | A | 12/2013 |
| JP | 2014076065 | A | 5/2014 |
| JP | 2014525237 | A | 9/2014 |
| JP | 2015506170 | A | 3/2015 |
| JP | 2015524257 | A | 8/2015 |
| KR | 20110006928 | A | 1/2011 |
| KR | 20110006928 | U | 7/2011 |
| KR | 101081481 | B1 | 11/2011 |
| RU | 2004116065 | A | 6/2005 |
| RU | 2311859 | C2 | 12/2007 |
| RU | 2336001 | C2 | 10/2008 |
| RU | 89927 | U1 | 12/2009 |
| RU | 94815 | U1 | 6/2010 |
| RU | 103281 | U1 | 4/2011 |
| RU | 2420290 | C2 | 6/2011 |
| RU | 110608 | U1 | 11/2011 |
| RU | 115629 | U1 | 5/2012 |
| RU | 122000 | U1 | 11/2012 |
| RU | 124120 | U1 | 1/2013 |
| RU | 2480485 | C2 | 4/2013 |
| RU | 145715 | U1 | 9/2014 |
| RU | 158129 | U1 | 12/2015 |
| SU | 1641182 | A3 | 4/1991 |
| TW | 201225862 | A | 7/2012 |
| WO | 9406313 | A1 | 3/1994 |
| WO | 9502712 | A2 | 1/1995 |
| WO | 9527412 | A1 | 10/1995 |
| WO | 9632854 | A2 | 10/1996 |
| WO | 9639880 | A1 | 12/1996 |
| WO | 9748293 | A1 | 12/1997 |
| WO | 9836651 | A1 | 8/1998 |
| WO | 0009188 | A1 | 2/2000 |
| WO | 0021598 | A1 | 4/2000 |
| WO | 02058747 | A1 | 8/2002 |
| WO | 03028409 | A1 | 4/2003 |
| WO | 03050405 | A1 | 6/2003 |
| WO | 03083283 | A1 | 10/2003 |
| WO | 03101454 | A1 | 12/2003 |
| WO | 2004022128 | A2 | 3/2004 |
| WO | 2004022242 | A1 | 3/2004 |
| WO | 2004022243 | A1 | 3/2004 |
| WO | 2004080216 | A1 | 9/2004 |
| WO | 2005106350 | A2 | 11/2005 |
| WO | 2006048774 | A1 | 5/2006 |
| WO | 2006082571 | A1 | 8/2006 |
| WO | 2007012007 | A2 | 1/2007 |
| WO | 2007042941 | A2 | 4/2007 |
| WO | 2007078273 | A1 | 7/2007 |
| WO | 2007131449 | A1 | 11/2007 |
| WO | 2008015441 | A1 | 2/2008 |
| WO | 2008029381 | A2 | 3/2008 |
| WO | 2009015410 | A1 | 2/2009 |
| WO | 2009022232 | A2 | 2/2009 |
| WO | 2009132793 | A1 | 11/2009 |
| WO | 2010045670 | A1 | 4/2010 |
| WO | 2010045671 | A1 | 4/2010 |
| WO | 2010091593 | A1 | 8/2010 |
| WO | 2011060788 | A1 | 5/2011 |
| WO | 2011079932 | A1 | 7/2011 |
| WO | 2011106788 | A2 | 9/2011 |
| WO | 2011107737 | A1 | 9/2011 |
| WO | 2011109849 | A1 | 9/2011 |
| WO | 2011124033 | A1 | 10/2011 |
| WO | 2011137453 | A2 | 11/2011 |
| WO | 2011146372 | A2 | 11/2011 |
| WO | 2011160788 | A1 | 12/2011 |
| WO | 2012025496 | A1 | 3/2012 |
| WO | 2012072762 | A1 | 6/2012 |
| WO | 2012156700 | A1 | 11/2012 |
| WO | 2013034453 | A1 | 3/2013 |
| WO | 2013034460 | A1 | 3/2013 |
| WO | 2013057185 | A1 | 4/2013 |
| WO | 2013060784 | A2 | 5/2013 |
| WO | 2013076098 | A2 | 5/2013 |
| WO | 2013082173 | A1 | 6/2013 |
| WO | 2013083631 | A1 | 6/2013 |
| WO | 2013083634 | A1 | 6/2013 |
| WO | 2013098395 | A1 | 7/2013 |
| WO | 2013116558 | A1 | 8/2013 |
| WO | 2013116571 | A1 | 8/2013 |
| WO | 2013148810 | A1 | 10/2013 |
| WO | 2013149404 | A1 | 10/2013 |
| WO | 2013178766 | A1 | 12/2013 |
| WO | 2014061477 | A1 | 4/2014 |
| WO | 2014104078 | A1 | 7/2014 |
| WO | 2014106093 | A1 | 7/2014 |
| WO | 2014130695 | A1 | 8/2014 |
| WO | 2014136872 | A1 | 9/2014 |
| WO | 2014140320 | A1 | 9/2014 |
| WO | 2014150131 | A1 | 9/2014 |
| WO | 2015117702 | A1 | 8/2015 |
| WO | 2016156493 | A2 | 10/2016 |

(56) References Cited

FOREIGN PATENT DOCUMENTS

WO 2016162446 A1 10/2016
WO 2017055866 A1 4/2017

OTHER PUBLICATIONS

Aerosols, "Pulmonary Pharmacology: Delivery Devices and Medications," Sep. 6, 2017, available at www.cdeu.org/cecourses/z98207/ch4.html, 2 pages.
Application and File History for U.S. Appl. No. 14/415,540, filed Jan. 16, 2015, Inventor: Lord, 522 pages.
Application and File History for U.S. Appl. No. 14/415,552, filed Jan. 16, 2015, Inventor: Christopher Lord, 382 pages.
Application and File History for U.S. Appl. No. 15/563,065, filed Sep. 29, 2017, 471 pages, Inventor: Sutton.
Application and File History for U.S. Appl. No. 15/563,078, filed Sep. 29, 2017, 413 pages, Inventor: Sutton.
Application and File History for U.S. Appl. No. 15/563,086, filed Sep. 29, 2017, 433 pages, Inventor: Sutton.
Application and File History for U.S. Appl. No. 15/914,139, filed Mar. 7, 2018, 245 pages, Inventor: Lord et al.
Application and File History for U.S. Appl. No. 15/959,687, filed Apr. 23, 2018, 200 pages, Inventor: Christopher Lord.
Cambridge Dictionary, "Definition of Sleeve", dictionary/Cambridge.org/dictionary/English/sleeve, Feb. 9, 2019, 1 page.
CN101843368A Translation; Zhiping Chen, Year 2010, 11 pages.
Communication pursuant to Article 94(3) EPC for European Application No. 16189742.6, mailed on Dec. 4, 2020, 9 pages.
Decision to Grant mailed Apr. 6, 2016 for Russian Application No. 2015100881, 8 Pages.
Decision to Grant mailed Oct. 24, 2019 for Russian Application No. 2019118770, 11 pages.
Decision to Grant mailed Sep. 19, 2016 for Russian Application No. 2015100878, 12 pages.
Diener Electronic, "Plasma Polymerization," The company Diener electronic GmbH+Co. KG, Retrieved on Oct. 17, 2017, 19 pages.
Dunn P.D., et al., "Heat Pipes," Fourth Edition, Pergamon, ISBN0080419038, 1994, 14 pages.
Exam Report from European Application 16189742.6-1006, dated Dec. 19, 2019, 8 pages.
Examination Report for Australian Application No. 2015293686, dated Jul. 25, 2018, 6 pages.
Examination Report for European Application No. 15741289.1, dated Jun. 15, 2018, 6 pages.
Extended European Search Report for Application No. 15178588, mailed on Apr. 14, 2016, 2 pages.
Extended European Search Report for Application No. 16166656, mailed on Oct. 11, 2016, 9 pages.
Extended European Search Report for Application No. 16177005.2, mailed on Oct. 26, 2016, 7 pages.
Extended European Search Report for Application No. 17189951.1, mailed on Jan. 4, 2018, 11 pages.
Extended European Search Report for Application No. EP16189742.6, dated Mar. 17, 2017, 7 pages.
Extended European Search Report for European Application No. EP19174777.3, mailed Nov. 11, 2019, 7 pages.
Extended Search Report for European Application No. 18195423.1, dated Jan. 29, 2019, 11 pages.
First Office Action mailed Dec. 3, 2012 for Chinese Application No. 200980152395.4, 16 pages.
International Preliminary Report on Patentability for Application No. PCT/EP2016/057060, mailed on Jul. 12, 2017, 8 pages.
International Preliminary Report on Patentability for Application No. PCT/EP2016/057097, mailed on Oct. 12, 2017, 10 pages.
International Search Report and Written Opinion for Application No. PCT/EP2016/057097, mailed on Sep. 28, 2016, 14 pages.
International Preliminary Report on Patentability for Appl. No. PCT/EP2016/057064, mailed on Oct. 12, 2017, 10 pages.
International Preliminary Report on Patentability for Application No. PCT/AT2012/000017, mailed on Aug. 13, 2013, 5 pages.
International Preliminary Report on Patentability for Application No. PCT/EP2012/070647, dated on Apr. 22, 2014, 8 pages.
International Preliminary Report on Patentability for Application No. PCT/EP2013/064950, mailed on Oct. 31, 2014, 12 pages.
International Preliminary Report on Patentability for Application No. PCT/EP2013/064952, mailed on Oct. 27, 2014, 9 pages.
International Preliminary Report on Patentability for Application No. PCT/GB2014/051332, mailed on Nov. 12, 2015, 7 pages.
International Preliminary Report on Patentability for Application No. PCT/GB2014/051333, mailed on Aug. 5, 2015, 12 pages.
International Preliminary Report on Patentability for Application No. PCT/GB2014/051334, mailed on Nov. 12, 2015, 7 pages.
International Preliminary Report on Patentability for Application No. PCT/GB2015/051213, mailed on Jul. 14, 2016, 20 pages.
International Search Report and Written Opinion for Application No. PCT/AT2012/000017, mailed on Jul. 3, 2012, 6 pages.
International Search Report and Written Opinion for Application No. PCT/EP2012/003103, mailed on Nov. 26, 2012, 6 pages.
International Search Report and Written Opinion for Application No. PCT/EP2012/070647, mailed on Feb. 6, 2013, 9 pages.
International Search Report and Written Opinion for Application No. PCT/EP2013/064950, mailed on Dec. 2, 2013.
International Search Report and Written Opinion for Application No. PCT/EP2013/064952, mailed on Oct. 11, 2013, 7 pages.
International Search Report and Written Opinion for Application No. PCT/EP2016/057064, mailed on Oct. 19, 2016, 15 pages.
International Search Report and Written Opinion for Application No. PCT/GB2014/051332, mailed on Jul. 21, 2014, 8 pages.
International Search Report and Written Opinion for Application No. PCT/GB2014/051333, mailed on Jul. 17, 2014, 10 pages.
International Search Report and Written Opinion for Application No. PCT/GB2014/051334, mailed on Jul. 21, 2014, 8 pages.
International Search Report and Written Opinion mailed on Dec. 2, 2013, for Application No. PCT/ EP2013/064950 filed Jul. 15, 2013, 7 pages.
International Search Report for Application No. PCT/AT2009/000413, mailed on Jan. 25, 2010, 3 pages.
Search Report mailed May 17, 2020 for Chinese Application No. 201680020844.X, 4 pages.
Search Report mailed Oct. 20, 2015 for Great Britain Application No. GB1505595.7, 4 pages.
Search Report mailed Sep. 22, 2015 for Great Britain Application No. GB1505593.2, 6 pages.
Search Report mailed Apr. 24, 2017 for Russian Application No. 2015146843, 3 pages.
Search Report mailed Jan. 15, 2018, for Japanese Application No. 2017-504040, 8 pages (15 pages with translation).
Search Report mailed Oct. 7, 2015 for Great Britain Application No. GB1505597.3, 3 pages.
Second Office Action mailed Aug. 20, 2013 for Chinese Application No. 200980152395.4, 16 pages.
Written Opinion for Application No. PCT/EP2016/057060, mailed on Sep. 28, 2016, 8 pages.
Written Opinion for International Application No. PCT/EP2016/057060, mailed Apr. 7, 2017, 6 pages.
Written Opinion of the International Preliminary Examining Authority for International Application No. PCT/GB2015/051213, mailed on Mar. 29, 2016, 9 pages.
International Search Report for Application No. PCT/AT2009/000414, mailed on Jan. 26, 2010, 2 pages.
International Search Report for Application No. PCT/EP2016/057060, mailed on Sep. 28, 2016, 7 pages.
International Search Report for Application No. PCT/GB2015/051213, mailed on Jul. 16, 2015, 5 pages.
Korean Decision for Refusal for Korean Application No. KR2020110006928 dated Jan. 10, 2019.
Korean Notice of Trial Decision, IP Trial and Appeal Board, the 10'th Bureau, Trial Decision, Trial No. 2017 won 5687, mailed Aug. 14, 2019, 17 pages.
KR 101081481 Translation; Kim Hyung Yoon; Nov. 2011, 6 pages.

(56) References Cited

OTHER PUBLICATIONS

Kynol, "Standard Specifications of Kynol™ Activated Carbon Fiber Products," Sep. 19, 2013, 2 pages.
Notice of Opposition for European Patent No. EP2871984 dated Jun. 5, 2017, 17 pages.
Notice of Opposition Letter from EPO Opposition against the European Application No. 2358418, mailed Mar. 1, 2017, 60 pages.
Notice of Reasons for Rejection mailed Oct. 15, 2013 for Japanese Application No. 2011532464, 6 pages.
Notice of Reasons for Rejection mailed May 23, 2017 for Japanese Application No. 2016134648, 18 pages.
Notice of Reasons for Rejection mailed May 31, 2016 for Japanese Application No. 2015-137361, 6 pages.
Notice of Reasons for Rejection mailed Sep. 8, 2015 for Japanese Application No. 2014179732, 5 pages.
Office Action and Search Report mailed Jun. 21, 2019 for Chinese Application No. 201680020842.0, 25 pages.
Office Action and Search Report mailed Jul. 23, 2019 for Chinese Application No. CN201680020758.9, 21 pages.
Office Action and Search Report mailed Jun. 24, 2019 for Chinese Application No. CN201680020844.X, 22 pages.
Office Action dated Apr. 18, 2016 for Chinese Application No. 201380038055.5, 9 pages.
Office Action dated Aug. 24, 2018 for Chinese Application No. 201580040255.3, 8 pages.
Office Action for Canadian Application No. 2,878,959, dated Jan. 18, 2016, 6 pages.
Office Action for Canadian Application No. 2,878,973, dated Jan. 22, 2016, 6 pages.
Office Action for Canadian Application No. 2,954,848, dated Dec. 18, 2017, 4 pages.
Office Action for Chinese Application No. 201380038055.5, dated Jul. 11, 2017, 3 pages.
Office Action for Japanese Application No. 2015-522064, dated Dec. 28, 2015, 2 pages.
Office Action for Japanese Application No. 2015-522065, dated Jan. 5, 2016, 2 pages.
Office Action for Japanese Application No. 2015-522066, dated Dec. 8, 2015, 3 pages.
Office Action for Japanese Application No. 2015-522066, dated Jan. 5, 2016. 2 pages.
Office Action for Japanese Application No. 2017-504040, dated Feb. 22, 2018, 7 pages.
Office Action for Japanese Application No. 2017-504040, dated Oct. 9, 2018, 2 pages (5 pages with translation).
Office Action for Japanese Application No. 2017-551206, dated Oct. 23, 2019, 8 pages.
Office Action for Japanese Application No. 2018-206299, dated Oct. 6, 2020, 9 pages.
Office Action for Japanese Application No. 2019-124231, mailed Oct. 27, 2020, 8 pages.
Office Action For Russian Application No. 2020124363, mailed on Feb. 17, 2021, 3 pages.
Office Action mailed Jul. 2, 2019 for Chinese Application No. 201680020844.X, 22 pages.
Office Action mailed Oct. 2, 2018, for Japanese Application No. 2017-551205, 11 pages.
Office Action mailed Jan. 5, 2015 for Japanese Application No. 2015-522064, 2 pages.
Office Action mailed Aug. 6, 2019 for Japanese Application No. 2017-551218, 16 pages(Including Translation).
Office Action mailed Sep. 11, 2017 for Chinese Application No. 201480024988.3, 10 pages.
Office Action mailed Jan. 18, 2017 for Chinese Application No. 201480024978.X, 8 pages.
Office Action mailed May 22, 2020 for Chinese Application No. 201680020844.X, 21 pages.
Office Action mailed Sep. 22, 2017 for Russian Application No. 2014120213, 11 pages.
Office Action mailed Oct. 26, 2016 for Russian Application No. 2014120213, 7 pages.
Office Action mailed Dec. 30, 2016 for Chinese Application No. 201480024988.3, 26 pages.
Office Action mailed Oct. 30, 2018 for Japanese Application No. 2017-551218, 4 pages.
Office Action mailed Jul. 18, 2018 for Korean Application No. 10-2017-7034160,8 pages (16 pages including Translation).
Office Action mailed Mar. 15, 2018 for Korean Application No. 2017-7002235, 14 pages.
Office Action mailed Sep. 7, 2016, for Korean Application No. 10-2015-7001256, 11 pages.
Office Action mailed Sep. 8, 2016, for Korean Application No. 10-2015-7001257, 15 pages.
Office Action mailed Sep. 24, 2018 for Russian Application No. 2018118998, 6 pages.
Rudolph G., "The Influence of CO2 on the Sensory Characteristics of the Favor-System," 1987, Accessed at http://legacy.library.ucsf.edu/tid/sld5f100, 24 pages.
Search Report mailed Oct. 7, 2015 for corresponding GB Application No. 15505597.3, 3 pages.
"Office Action For Chinese Application No. 201811153475.9, mailed on Apr. 22, 2021", 17 pages.
"Office Action for Japanese Application No. 2018-206299, dated Apr. 13, 2021", 7 pages.

* cited by examiner

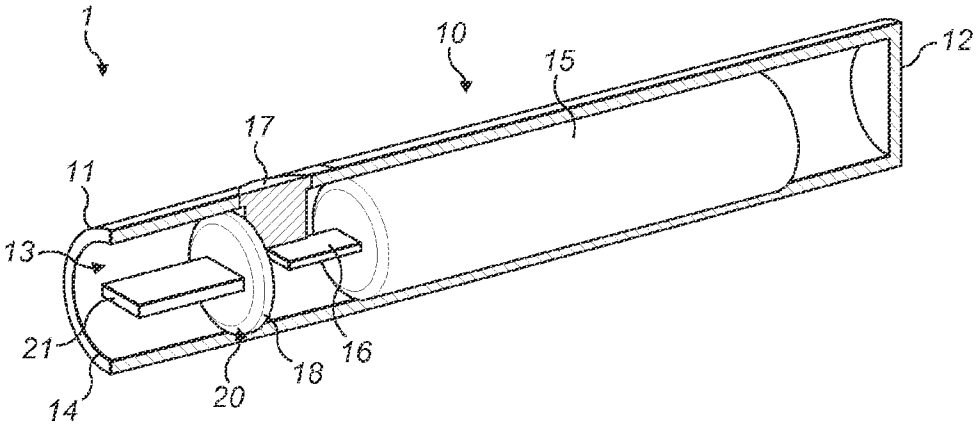
FIG. 7
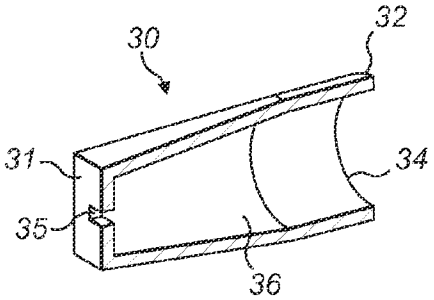

ARTICLE FOR USE WITH APPARATUS FOR HEATING SMOKABLE MATERIAL

CROSS-REFERENCE TO RELATED APPLICATIONS

The present application is a Divisional of U.S. application Ser. No. 15/563,086, filed Sep. 29, 2017 which in turn is a National Phase entry of PCT Application No. PCT/EP2016/057064, filed Mar. 31, 2016, which in turn claims priority from GB Patent Application No. 1505597.3, filed Mar. 31, 2015, each of which is hereby fully incorporated herein by reference.

TECHNICAL FIELD

The present disclosure relates to an article for use with apparatus for heating smokable material to volatilize at least one component of the smokable material.

BACKGROUND

Smoking articles such as cigarettes, cigars and the like burn tobacco during use to create tobacco smoke. Attempts have been made to provide alternatives to these articles by creating products that release compounds without combusting. Examples of such products are so-called "heat not burn" products or tobacco heating devices or products, which release compounds by heating, but not burning, material. The material may be, for example, tobacco or other non-tobacco products, which may or may not contain nicotine.

SUMMARY

According to the present disclosure, there is provided an article for use with apparatus for heating smokable material to volatilize at least one component of the smokable material, the article comprising: a carrier; and smokable material arranged on the carrier; wherein the smokable material comprises a first layer of smokable material and a second layer of smokable material, wherein the first layer of smokable material is located between the carrier and the second layer of smokable material; and wherein the smokable material of the first layer of smokable material has a form or chemical composition that differs from the form or chemical composition, respectively, of the smokable material of the second layer of smokable material. In an exemplary embodiment, the smokable material of one of the first and second layers of smokable material has a form or chemical composition so as to be heatable more quickly than the smokable material of the other of the first and second layers of smokable material. In an exemplary embodiment, the smokable material of one of the first and second layers of smokable material has a form or chemical composition so as to be heatable more quickly, to volatilize at least one component of the smokable material, than the smokable material of the other of the first and second layers of smokable material.

In an exemplary embodiment, the smokable material of the first layer of smokable material has a form or chemical composition so as to be heatable more quickly than the smokable material of the second layer of smokable material. In an exemplary embodiment, the smokable material of the first layer of smokable material has a form or chemical composition so as to be heatable more quickly, to volatilize at least one component of the smokable material, than the smokable material of the second layer of smokable material.

In an exemplary embodiment, the smokable material of one of the first and second layers of smokable material comprises particles of the smokable material having a first mean particle size, and the smokable material of the other of the first and second layers of smokable material comprises particles of the smokable material having a second mean particle size that is greater than the first mean particle size.

In an exemplary embodiment, the smokable material of the first layer of smokable material comprises the particles of smokable material having the first mean particle size, and the smokable material of the second layer of smokable material comprises the particles of smokable material having the second mean particle size.

In an exemplary embodiment, the smokable material of one of the first and second layers of smokable material comprises an aerosol forming agent, and the smokable material of the other of the first and second layers of smokable material is free or substantially free of the aerosol forming agent.

In an exemplary embodiment, the smokable material of the first layer of smokable material comprises the aerosol forming agent, and the smokable material of the second layer of smokable material is free or substantially free of the aerosol forming agent.

In an exemplary embodiment, the aerosol forming agent comprises glycerol.

In an exemplary embodiment, the first layer of the smokable material is bonded to the carrier.

In an exemplary embodiment, the first layer of the smokable material is bonded by an adhesive to the carrier.

In an exemplary embodiment, the second layer of smokable material is in contact with the first layer of smokable material.

In an exemplary embodiment, the second layer of smokable material is out of contact with the carrier.

In an exemplary embodiment, the carrier is for conducting heat through the carrier towards the smokable material.

In an exemplary embodiment, the article comprises a pouch containing the smokable material, and the carrier forms at least a portion of a wall of the pouch.

In an exemplary embodiment, the smokable material comprises tobacco.

There is also provided a cartridge for use with apparatus for heating smokable material to volatilize at least one component of the smokable material, the cartridge comprising an article as described above.

In an exemplary embodiment, the cartridge comprises a housing defining a chamber, the carrier defines part of an exterior surface of the cartridge, and the smokable material is located within the chamber.

In an exemplary embodiment, the exterior surface of the cartridge comprises a cavity for receiving a heater for heating the smokable material, and the carrier defines at least part of the cavity.

In an exemplary embodiment, the cavity has a mouth and a longitudinal axis, and a cross-sectional size of the cavity perpendicular to the axis decreases with distance from the mouth over at least a majority of a length of the cavity.

In an exemplary embodiment, the cross-sectional size of the cavity decreases with distance from the mouth over the full length of the cavity.

In an exemplary embodiment, the cavity is a wedge-shaped cavity or a dome-shaped cavity.

There is also provided a kit comprising an article as described above or a cartridge as described above, and apparatus for heating the smokable material to volatilize at least one component of the smokable material.

In an exemplary embodiment, the apparatus is for heating the smokable material to volatilize the at least one component of the smokable material without combusting the smokable material.

In an exemplary embodiment, the apparatus comprises a heating device for heating the smokable material, and a controller for controlling heating of the heating device so as to cause heating of the smokable material to volatilize the at least one component of the smokable material without combusting the smokable material.

BRIEF DESCRIPTION OF THE DRAWINGS

Embodiments of the disclosure will now be described, by way of example only, with reference to the accompanying drawings, in which:

FIG. 7 shows a partially cut-away perspective view of an example of an apparatus for heating smokable material to volatilize at least one component of the smokable material.

DETAILED DESCRIPTION

As used herein, the term "smokable material" includes materials that provide volatilized components upon heating, typically in the form of an aerosol. "Smokable material" may be a non-tobacco-containing material or a tobacco-containing material. "Smokable material" may, for example, include one or more of tobacco per se, tobacco derivatives, expanded tobacco, reconstituted tobacco, tobacco extract, homogenized tobacco or tobacco substitutes. The smokable material can be in the form of ground tobacco, cut rag tobacco, extruded tobacco, gel or agglomerates. "Smokable material" also may include other, non-tobacco, products, which, depending on the product, may or may not contain nicotine.

As used herein, the terms "flavor" and "flavorant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may comprise natural or nature-identical aroma chemicals. They may be in any suitable form, for example, oil, liquid, powder, or gel.

Figure 1:
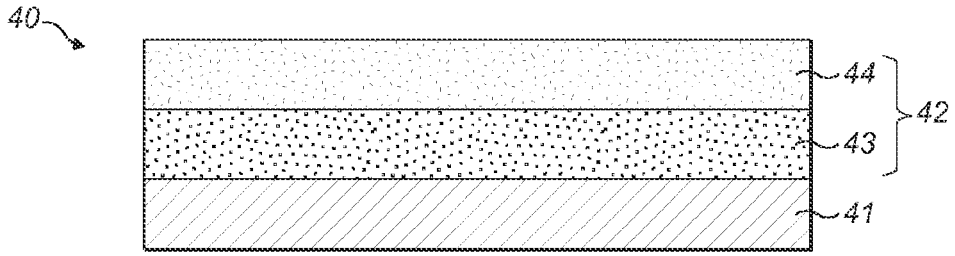
FIG. 1 shows a schematic cross-sectional view of an example of an article for use with apparatus for heating smokable material to volatilize at least one component of the smokable material.

Referring to FIG. 1 there is shown a schematic cross-sectional view of an example of an article 40 according to an embodiment of the disclosure. The article 40 comprises a carrier 41 and smokable material 42 arranged on the carrier 41. The smokable material 42 comprises a first layer of smokable material 43 and a second layer of smokable material 44. The first layer of smokable material 43 is located between the carrier 41 and the second layer of smokable material 44. In this embodiment, the first layer of smokable material 43 is bonded by an adhesive (not shown) to the carrier 41. In other embodiments, the first layer of smokable material 43 may be bonded to the carrier 41, or arranged on the carrier 41, by some other mechanism. In this embodiment, the first layer of smokable material 43 has a first thickness within a range of about 0.5 mm to 3 mm, or 0.1 mm to 2.0 mm, or 1.0 mm to 1.4 mm. In this embodiment, the second layer of smokable material 44 has a second thickness within a range of about 0.5 mm to 3 mm, or 0.1 mm to 2.0 mm, or 1.0 mm to 1.4 mm. In other embodiments, the first and second thicknesses may be other than within these ranges.

In this embodiment, the carrier 41 is for conducting heat through the carrier 41 towards the smokable material 42. The carrier 41 comprises a metal foil, such as aluminum foil, but in other embodiments the carrier 41 may comprise paper, a non-metal foil, a polymer, a plastics material, or a combination of foil and paper, or the like. In some embodiments, the carrier 41 may comprise a first layer of material, for example a paper such as reconstituted tobacco paper, and a second layer of material, for example a metal foil, attached to the first layer of material. In some embodiments, the first layer of smokable material 43 may be more readily bondable or adherable to the material of the first layer of material than to the material of the second layer of material. In some embodiments, the material of the second layer of material may be more rigid or robust than the material of the first layer of material. Thus, in some embodiments, the first layer of material may facilitate adhering the smokable material 42 to the carrier 41, and the second layer of material may increase the rigidity and/or robustness of the carrier 41.

In this embodiment, the second layer of smokable material 44 is in contact with the first layer of smokable material 43. In other embodiments, there may be other material between the first and second layers of smokable material 43, 44. Such other material may increase the rigidity or robustness of the article 40, may help retain the relative positions of the first and second layers of smokable material 43, 44, and/or may help hold different regions of the smokable material 42 together. An example such other material is a layer of paper, such as reconstituted tobacco paper. In this embodiment, the second layer of smokable material 44 is out of contact with the carrier 41. In other embodiments, one or more sections of the second layer of smokable material 44 may be in contact with the carrier 41.

In embodiments of the present disclosure, the smokable material of the first layer of smokable material 43 has a form or chemical composition that differs from the form or chemical composition, respectively, of the smokable material of the second layer of smokable material 44. In some embodiments, the smokable material of one of the first and second layers of smokable material 43, 44 has a form or chemical composition so as to be heatable more quickly, for example to volatilize at least one component of the smokable material, than the smokable material of the other of the first and second layers of smokable material 43, 44. For example, it may be the smokable material of the first layer of smokable material 43 that has the form or chemical composition so as to be heatable more quickly, for example to volatilize at least one component of the smokable material, than the smokable material of the second layer of smokable material 44.

By providing the first and second layers of smokable material 43, 44 with different forms or chemical compositions, in some embodiments progressive heating of the smokable material 42, and thereby progressive generation of aerosol for user inhalation, is achievable. More specifically, the respective forms or chemical compositions of the first and second layers of smokable material 43, 44 may be selected such that, in use, only a relatively small degree of heating of the carrier 41 is required to cause the first layer of smokable material 43 to become heated, thereby to initiate volatilization of at least one component of the smokable material in the first layer of smokable material 43. The volatilized component(s) may be cooled, such as by flowing air, so that they condense to form an aerosol. As the carrier 41 is further heated, the second layer of smokable material 44 may become sufficiently heated to initiate volatilization of at least one component of the smokable material in the second layer of smokable material 44, which also may be cooled so as to condense to form an aerosol. Accordingly, on activation by a user, components of the smokable material are able to be volatilized relatively rapidly, and components of the smokable material continue to be volatilized thereafter even after the first layer of smokable material 43 becomes exhausted of volatile components. Accordingly, progressive generation of aerosol is achievable.

In other embodiments, the difference in form or chemical composition may instead act to compensate for a greater distance between the carrier 41 and the second layer of smokable material 44, as compared to the distance between the carrier 41 and the first layer of smokable material 43. The latter distance may be zero. For example, the respective forms or chemical compositions of the first and second layers of smokable material 43, 44 may be selected such that, on heating of the carrier 41, at least one component of the smokable material of each of the first and second layers of smokable material 43, 44 is volatilized at substantially the same time. Also, aerosol may be formed from the volatilized components from each of the first and second layers of smokable material 43, 44 at substantially the same time, as a result of condensing the volatilized components by cooling.

In some embodiments, the difference in form between the first and second layers of smokable material 43, 44 may comprise a difference in mean sizes of particles of the smokable material in the first and second layers of smokable material 43, 44. That is, in some embodiments, the smokable material of one of the first and second layers of smokable material 43, 44 comprises particles of the smokable material having a first mean particle size, and the smokable material of the other of the first and second layers of smokable material 43, 44 comprises particles of the smokable material having a second mean particle size that is greater than the first mean particle size. In some embodiments, the smokable material 42 as a whole may have a mean particle size of between 0.6 and 0.9 mm or between 0.7 and 0.8 mm. The smokable material 42 may be prepared using mesh separation or sieves, for example with sieve hole sizes selected so as to separate particles of the smokable material having a particle size within the desired range from particles of the smokable material having a particle size outside of the desired range.

Typically, particles of smokable material having a smaller mean particle size are heatable more quickly, for example to volatilize at least one component of the smokable material, by a given heat source than are particles of the smokable material having a greater mean particle size. By providing the first and second layers of smokable material 43, 44 with different mean particle sizes, in some embodiments progressive heating of the smokable material, and thereby progressive generation of aerosol, on heating the carrier 41 is achievable substantially as discussed above. In other embodiments, simultaneous volatilization of at least one component of the smokable material in each of the first and second layers of smokable material 43, 44 on heating the carrier 41, and simultaneous generation of aerosol using the volatilized components from each of the first and second layers of smokable material 43, 44, is achievable substantially as discussed above.

In the article 40 shown in FIG. 1, the smokable material of the first layer of smokable material 43 has a form so as to be heatable more quickly, for example to volatilize at least one component of the smokable material, than the smokable material of the second layer of smokable material 44. More specifically, in this embodiment the smokable material of the first layer of smokable material 43 comprises the particles of smokable material having the first mean particle size, and the smokable material of the second layer of smokable material 44 comprises the particles of smokable material having the second mean particle size. Thus, in use, as the carrier 41 is heated, the particles of smokable material of the first layer of smokable material 43 are heated more quickly, for example to volatilize at least one component of the smokable material, than are particles of smokable material of the second layer of smokable material 44. Combined with the feature of this embodiment that the first layer of smokable material 43 also is closer to the carrier 41 than is the second layer of smokable material 44, at least one component of the smokable material of the first layer of smokable material 43 may be volatilized well in advance of components of the smokable material of the second layer of smokable material 44 on heating of the carrier 41.

In a variation to the article 40 shown in FIG. 1, the smokable material of the second layer of smokable material 44 may comprise the particles of smokable material having the first mean particle size, and the smokable material of the first layer of smokable material 43 may comprise the particles of smokable material having the second mean particle size. The provision of these features may provide the compensatory effect described above, for example so that at least one component of the smokable material is volatilized in the first and second layers of smokable material 43, 44 substantially simultaneously on heating the carrier 41, or so as to reduce or avoid a potential delay in volatilization of at least one component of the smokable material in the second layer of smokable material 44 on heating the carrier 41.

In some embodiments, the first and second layers of smokable material 43, 44 have different chemical compositions. Accordingly, depending on the chemical compositions employed, in some embodiments progressive volatilization of at least one component of the smokable material on heating the carrier 41 is achievable substantially as discussed above. In other embodiments, simultaneous volatilization of at least one component of the smokable material in the first and second layers of smokable material 43, 44 on heating the carrier 41 is achievable substantially as discussed above, or a potential delay in volatilization of at least one component of the smokable material in the second layer of smokable material 44 on heating the carrier 41 is reduced or avoided on heating the carrier 41.

In some embodiments, the difference in chemical composition between the first and second layers of smokable material 43, 44 may comprise a difference in quantities by weight of an aerosol forming agent, such as glycerol, in each of the first and second layers 43, 44, as a percentage of a total weight of the smokable material of the respective first and second layers 43, 44. For example, in some embodiments, the smokable material of one of the first and second layers of smokable material 43, 44 may comprise an aerosol forming agent such as glycerol, and the smokable material of the other of the first and second layers of smokable material 43, 44 may be free, or substantially free, of the aerosol forming agent. For example, it may be the smokable material of the first layer of smokable material 43 that comprises the aerosol forming agent. In other embodiments, both of the first and second layers of smokable material 43, 44 may comprise the aerosol forming agent, but one of the first and second layers of smokable material 43, 44 may comprise more of the aerosol forming agent than the other of the first and second layers of smokable material 43, 44, as measured by weight of the aerosol forming agent in each of the first and second layers 43, 44, as a percentage of a total weight of the smokable material of the respective first and second layers 43, 44.

In some embodiments, the difference in chemical composition between the first and second layers of smokable material 43, 44 may comprise a difference in quantities by weight of a smoke modifying substance, such as a flavorant, in each of the first and second layers 43, 44, as a percentage of a total weight of the smokable material of the respective first and second layers 43, 44. For example, in some embodiments, the smokable material of one of the first and second layers of smokable material 43, 44 may comprise a flavorant, and the smokable material of the other of the first and second layers of smokable material 44 may be free, or substantially free, of the flavorant. In some embodiments, one of the first and second layers of smokable material 43, 44 may comprise a first flavorant, and the other of the first and second layers of smokable material 43, 44 may comprise a second flavorant that is different to the first flavorant. By providing the first and second layers of smokable material 43, 44 with different quantities of smoke modifying agents or flavorants, in some embodiments a change in flavor of generated aerosol for user inhalation is achievable.

Figure 2:
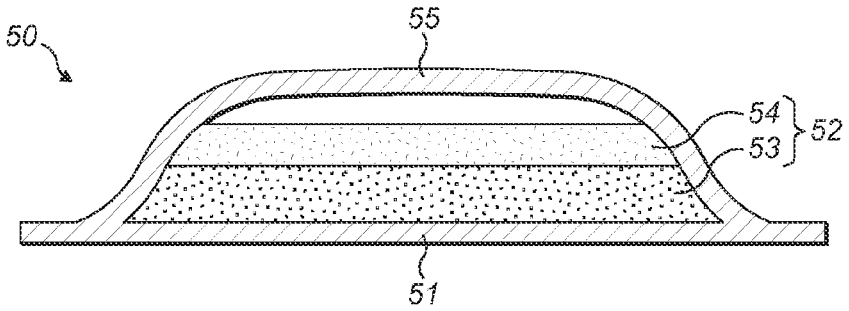
FIG. 2 shows a schematic cross-sectional view of an example of another article for use with apparatus for heating smokable material to volatilize at least one component of the smokable material.

In some embodiments, the article comprises a pouch containing the smokable material, and the carrier forms at least a portion of a wall of the pouch. Referring to FIG. 2 there is shown a schematic cross-sectional view of an example of such an article 50 according to an embodiment of the disclosure.

The article 50 comprises a pouch for use with apparatus for heating smokable material to volatilize at least one component of the smokable material. The pouch comprises a first wall 51 and a second wall 55, and the pouch contains smokable material 52 between the first wall 51 and the second wall 55. The first wall 51 functions as a carrier, and in this embodiment the carrier 51 and the smokable material 52 correspond to the carrier 41 and smokable material 42 described above with reference to FIG. 1. Thus, the smokable material 52 contained in the pouch comprises a first layer of smokable material 53 and a second layer of smokable material 54, and the first layer of smokable material 53 is located between the carrier 51 and the second layer of smokable material 54. In this embodiment, the second layer of smokable material 54 is located between the second wall 55 and the first layer of smokable material 53.

In other embodiments in which the article comprises a pouch containing smokable material and the carrier forms at least a portion of a wall of the pouch, the carrier may take any of the other forms discussed above, and the smokable material may take any of the other forms discussed above. As can be seen, in the embodiment shown in FIG. 2, the first wall 51 and second wall 55 of the pouch form a closed container for the smokable material 52.

In some embodiments of the article, in which the article comprises a pouch containing smokable material and the carrier forms at least a portion of a wall of the pouch, the first wall 51 of the pouch may be made of a first material, and the second wall 55 of the pouch may be made of a second material that is a different material to the first material. In other embodiments, the first and second walls 51, 55 may be made of the same material, such as the second material. In some embodiments, the second material may be a porous material for permitting aerosol or volatilized material generated within the pouch to pass out of the pouch from within the pouch, and the first wall 51 may be made of a material that is less porous to the aerosol or volatilized material than the porous material. For example, the second material may comprise one or more materials selected from the group consisting of: fleece, viscose, non-woven material, non-woven fleece, woven material, knitted material, nylon, and polyester.

Figure 3:
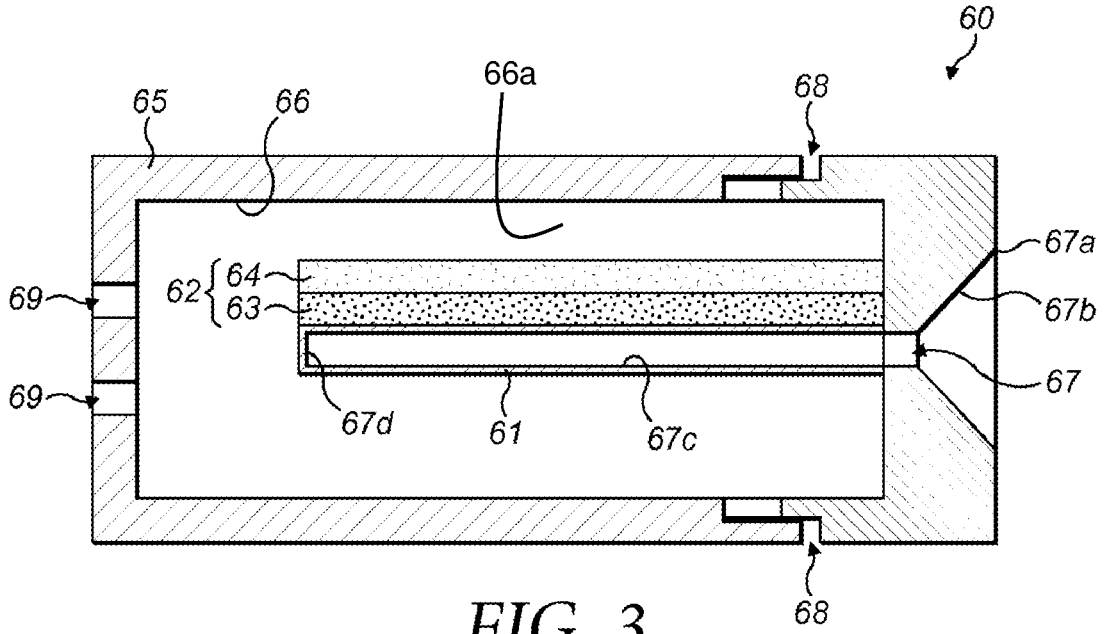
FIG. 3 shows a schematic cross-sectional view of an example of a cartridge for use with apparatus for heating smokable material to volatilize at least one component of the smokable material.

In some embodiments, the article is incorporated into a cartridge for use with apparatus for heating smokable material to volatilize at least one component of the smokable material. Referring to FIG. 3 there is shown a schematic cross-sectional view of an example of such a cartridge 60 according to an embodiment of the disclosure.

The cartridge 60 comprises a housing 65 defining a chamber 66. A carrier 61 defines part of an exterior surface of the cartridge 60, and smokable material 62 is located within the chamber 66. The "exterior surface" may be a surface that envelops the rest of the cartridge 60, or that delineates the cartridge 60. In this embodiment the carrier 61 and the smokable material 62 correspond to the carrier 41 and smokable material 42 described above with reference to FIG. 1. Thus, the smokable material 62 located within the chamber 66 comprises a first layer of smokable material 63 and a second layer of smokable material 64, and the first layer of smokable material 63 is located between the carrier 61 and the second layer of smokable material 64. In this embodiment, the second layer of smokable material 64 is located between the housing 65 and the first layer of smokable material 63.

In this embodiment, air flow inlets 68 extend through the housing 65 for admitting air into the chamber 66 from an exterior of the housing 65. In other embodiments, there may be only one air flow inlet 68 in place of the plurality of air flow inlets 68. In this embodiment, apertures 69 extend through the housing 65. Each of the apertures 69 is a volatilized material outlet 69 for permitting volatilized material generated within the chamber 66 by heating of the smokable material 62 to pass from the chamber 66, through an air gap 66*a* and out of the housing 65. In other embodiments, there may be only one aperture 69 in place of the plurality of apertures 69.

In this embodiment, the exterior surface of the cartridge 60 comprises a cavity 67 for receiving a heater for heating the smokable material 62 in use, and the carrier 61 defines at least part of the cavity 67. That is, the exterior surface of the cartridge 60 comprises a portion that is recessed to provide the cavity 67. Accordingly, in this embodiment, the carrier 61 defines part of the exterior surface of the housing 65 of the cartridge 60, as outlined above. In this embodiment, the cavity 67 is a blind hole having a mouth 67*a*, first and second trunk sections 67*b*, 67*c*, and a closed end 67*d*. The first trunk section 67*b* connects the mouth 67*a* to the second trunk section 67*c*, and the second trunk section 67*c* connects the first trunk section 67*b* to the closed end 67*d*. In this embodiment, the second trunk section 67*c* is of constant, or substantially constant, cross-sectional shape and size (for example, a width, a height, a diameter, a dimension, or an area) throughout its length between the first trunk section 67*b* and the closed end 67*d*. On the other hand, a cross-sectional size (for example, a width, a height, a diameter, a dimension, or an area) of the first trunk section 67*b* decreases with distance from the mouth 67*a* so as to have a tapered profile. The tapered profile helps a user to guide the heater into the cavity 67 in use. In some embodiments, the cavity 67 may instead be a through hole.

Figure 4:
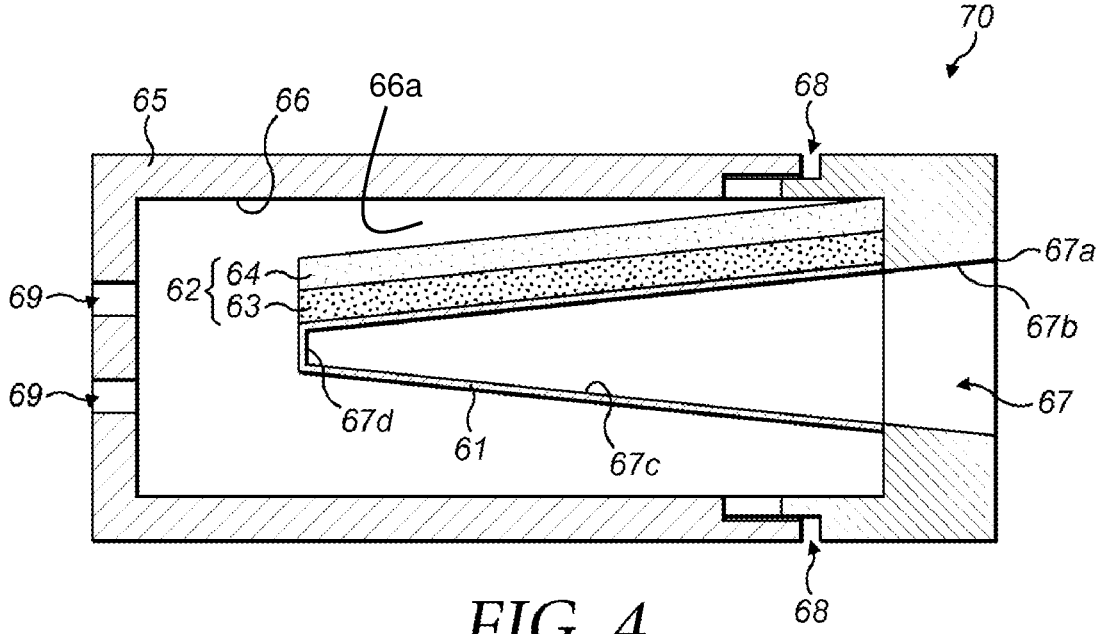
FIG. 4 shows a schematic cross-sectional view of an example of another cartridge for use with apparatus for heating smokable material to volatilize at least one component of the smokable material.
Figure 5:
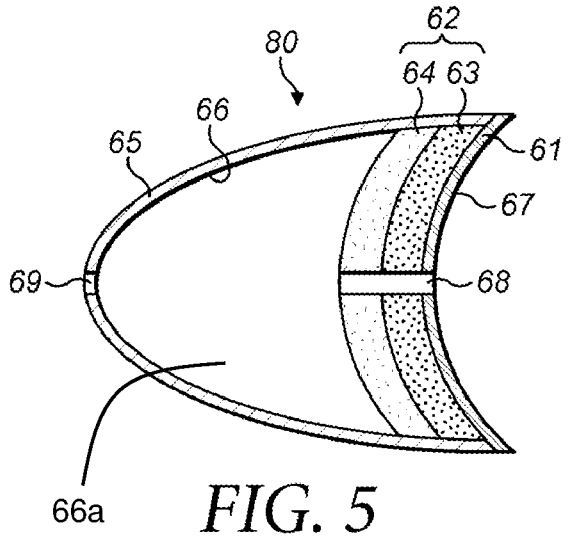
FIG. 5 shows a schematic cross-sectional view of an example of another cartridge for use with apparatus for heating smokable material to volatilize at least one component of the smokable material.

In other embodiments, the cavity 67 may have a different shape. For example, in some embodiments, the cross-sectional size of the cavity 67 decreases with distance from the mouth 67*a* over the full length of the cavity 67. Referring to FIGS. 4 and 5 there are shown schematic cross-sectional views of examples of such cartridges 70, 80 according to two respective embodiments of the disclosure. Like elements in FIG. 3 and FIGS. 4 and 5 are denoted with like reference numerals, and discussion thereof is not included in the interests of conciseness. In brief, the cavity 67 of the cartridge 70 of FIG. 4 is a wedge-shaped cavity, and the cavity 67 of the cartridge 80 of FIG. 5 is a dome-shaped cavity. In the embodiments shown in FIGS. 4 and 5, the wedge-shaped and dome-shaped cavities 67 are symmetrical or rotationally-symmetrical. In other embodiments, they may instead be asymmetrical.

Figure 6:
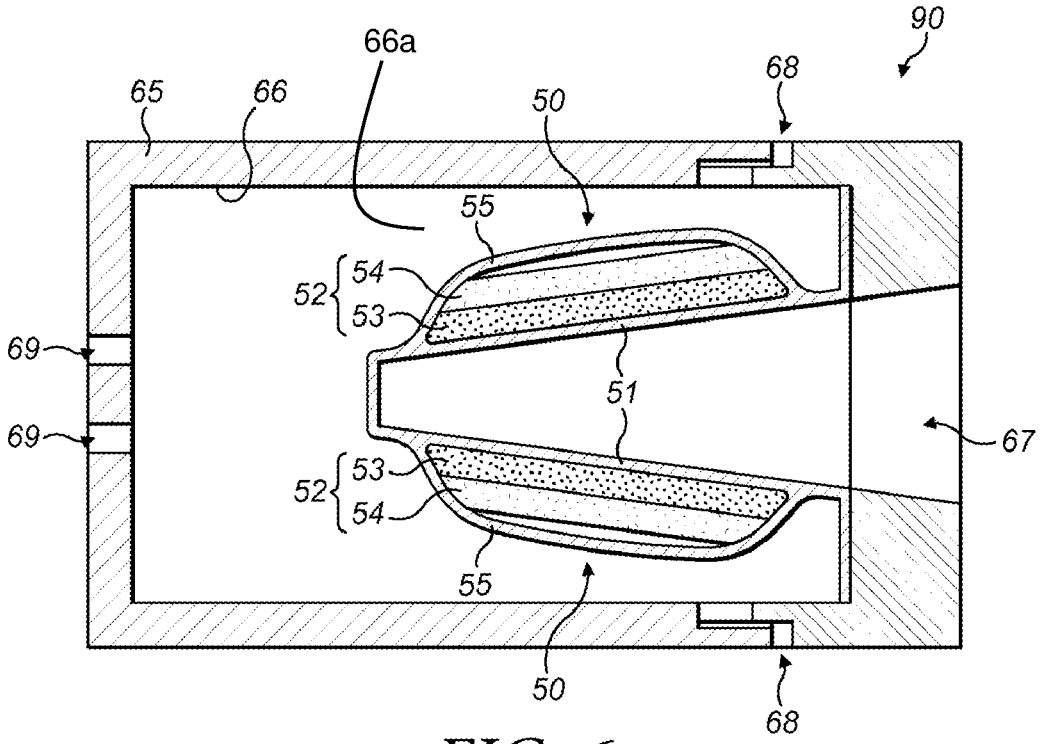
FIG. 6 shows a schematic cross-sectional view of an example of another cartridge for use with apparatus for heating smokable material to volatilize at least one component of the smokable material.

Referring to FIG. 6 there is shown a schematic cross-sectional view of an example of a further cartridge 90 according to an embodiment of the disclosure. The cartridge 90 of FIG. 6 is the same as the cartridge 70 of FIG. 4, except that the cartridge 90 of FIG. 6 includes two of the articles 50 of FIG. 2 within the chamber 66 defined by the housing 65 and connected together by means of a connector. In the cartridge 90 of FIG. 6, the first wall 51, i.e. the carrier 51, of each of the pouches defines at least part of the cavity 67. Accordingly, in this embodiment, each of the respective carriers 51, and thus each of the respective pouches, defines part of the exterior surface of the cartridge 90. In another embodiment that is a variant of the embodiment shown in FIG. 6, the cartridge may comprise only one article 50 of FIG. 2 within the chamber 66, so that only one carrier 51 of a pouch defines at least part of the cavity 67. The rest of the cavity 67 would be defined by one or more further elements.

In other embodiments in which the article is incorporated into a cartridge, the carrier may take any of the other forms discussed above, and the smokable material may take any of the other forms discussed above.

Each of the articles and cartridges 40, 50, 60, 70, 80, 90 shown in FIGS. 1 to 6, and each of the other articles and cartridges described above, is usable with an apparatus (not shown) for heating smokable material to volatilize at least one component of the smokable material. In some embodiments, the apparatus is for heating the smokable material 42, 52, 62 of the article or cartridge 40, 50, 60, 70, 80, 90 to volatilize at least one component of the smokable material 42, 52, 62 without combusting, or burning, the smokable material.

In some respective embodiments, the apparatus comprises a heating device having a heater that is for contacting, or for coming into close proximity to, the carrier 41, 51, 61 of one of the respective articles or cartridges 40, 50, 60, 70, 80, 90 discussed above and shown in FIGS. 1 to 6. In some embodiments, the heater has a surface profile that matches, or closely matches, a surface profile of the carrier 41, 51, 61. This helps provide good conduction of heat from the heater to the smokable material 42, 52, 62 arranged on the carrier 41, 51, 61. In some embodiments, the heater has a profile for being inserted into the cavity 67 of one of the respective cartridges 60, 70, 80, 90 discussed above and shown in FIGS. 3 to 6.

In some embodiments, the apparatus comprises a controller for controlling heating of the heating device so as to cause heating of the smokable material 42, 52, 62 to volatilize the at least one component of the smokable material 42, 52, 62 without combusting the smokable material 42, 52, 62. In some embodiments, the controller is for controlling the supply of power from a power source to the heating device. In some embodiments, the controller is configured to ensure that the temperature of the heater remains within a temperature range of about 150 degrees Celsius to about 300 degrees Celsius, or about 170 degrees Celsius to about 220 degrees Celsius. In some embodiments, within this temperature range, the smokable material 42, 52, 62 of the article or cartridge 40, 50, 60, 70, 80, 90 is heated sufficiently to volatilize at least one component of the smokable material 42, 52, 62 without combusting the smokable material 42, 52, 62. In other embodiments, the temperature range of heating may be other than this range. In some embodiments, following the volatilization of the at least one component of the smokable material 42, 52, 62, an aerosol for inhalation by a user is formed. For example, a user drawing on an outlet of the apparatus may draw air through the apparatus, which cools the volatilized component(s) of the smokable material 42, 52, 62 within air gap 66*a* so that they condense to form the aerosol.

In each of the above described embodiments, the smokable material 42, 52, 62 comprises tobacco. However, in respective variations to each of these embodiments, the smokable material 42, 52, 62 may consist of tobacco, may consist substantially entirely of tobacco, may comprise tobacco and smokable material other than tobacco, may comprise smokable material other than tobacco, or may be free of tobacco. In some embodiments, the smokable material 42, 52, 62 may include an aerosol forming agent, such as glycerol.

In each of the above described embodiments, the article or cartridge 40, 50, 60, 70, 80, 90 is a consumable article or cartridge. Once all, or substantially all, of the volatile component(s) of the smokable material 42, 52, 62 in the article or cartridge 40, 50, 60, 70, 80, 90 has/have been spent, the user may remove the article or cartridge 40, 50, 60, 70, 80, 90 from the apparatus and dispose of the article or cartridge 40, 50, 60, 70, 80, 90. The user may subsequently re-use the apparatus with another of the articles or cartridges 40, 50, 60, 70, 80, 90. However, in other respective embodiments, the article or cartridge 40, 50, 60, 70, 80, 90 may be non-consumable, and the combination of the apparatus and the article or cartridge 40, 50, 60, 70, 80, 90 may be disposed of together once the volatile component(s) of the smokable material 42, 52, 62 has/have been spent.

In some embodiments, the apparatus discussed above may be sold, supplied or otherwise provided separately from the article or cartridge 40, 50, 60, 70, 80, 90 with which the apparatus is usable. However, in other embodiments, the apparatus and one or more of the articles and/or cartridges 40, 50, 60, 70, 80, 90 may be provided together as a kit.

Referring to FIG. 7, there is shown a partially cut-away perspective view of an example of an apparatus 1 for heating smokable material to volatilize at least one component of the smokable material. The apparatus 1 is particularly suitable for use with a cartridge 60 as described above with reference to FIG. 3. The apparatus 1 has a body 10 which is generally tubular and elongate, has first and second opposite longitudinal ends 11, 12, and defines an interface for co-operating with the cartridge 60. In this embodiment, the interface comprises a recess 13 for receiving the cartridge 60. In other embodiments, the interface can take a different form, such as a shelf, a surface, or a projection, and optionally requires mechanical mating with the cartridge 60 in order to cooperate with the cartridge 60. The first longitudinal end 11 of the body 10 defines an opening 14 into the recess 13 at a first end of the recess 13. The opening 14 is shaped and sized so that the cartridge 60 is movable through the opening 14 to allow a user to insert the cartridge 60 into the recess 13 and/or to remove the cartridge 60 from the recess 13.

In this embodiment, the mouthpiece 30 is generally tubular and elongate and has first and second opposite longitudinal ends 31, 32. The mouthpiece 30 comprises an inlet 34 at the second longitudinal end 32 of the mouthpiece 30, an outlet 35 at the first longitudinal end 31 of the mouthpiece 30, and a channel 36 fluidly connecting the inlet 34 with the outlet 35. The second longitudinal end 32 of the mouthpiece 30 comprises a connector (not shown) that is releasably engageable with a connector (not shown) of the first longitudinal end 11 of the body 10, so as to connect the mouthpiece 30 to the body 10. In other embodiments, the mouthpiece 30 and the body 10 may be permanently connected, such as through a hinge or flexible member. When the apparatus 1 is in use, the first longitudinal end 31 of the mouthpiece 30 forms a first longitudinal end of the apparatus 1, and the second longitudinal end 12 of the body 10 forms a second longitudinal end of the apparatus 1.

In this embodiment, the recess 13 and the opening 14 into the recess 13 are defined by the body 10 of the apparatus 1. In this embodiment, the heating device 20 comprises a heater 21 extending along a longitudinal axis of the recess 13. The heater 21 has a rectangular cross-sectional shape in a plane perpendicular to the axis. However, in other embodiments, the cross-sectional shape of the heater 21 may be other than rectangular, such as square, cylindrical, elliptical or polygonal. The heater 21 is suitable for insertion into the cavity 67 of the cartridge 60. The heater 21 has a length in the direction of the axis, a width perpendicular to the length, and a height perpendicular to the width and the length. The width and height of the heater 21 are slightly less than the width and height, respectively, of the cavity 67 of the cartridge 60, to facilitate insertion of the heater 21 into the cavity 67. The heating device 20 comprises a retainer 18 that is fixed to the body 10 so as to retain the heater 21 in position relative to the body 10. In this embodiment, the heater 21 extends from a second end of the recess 13 to the first end of the recess 13. That is, the heater 21 extends along the full axial length of the recess 13. However, in other embodiments, the heater 21 may extend along only part of the length of the recess 13 from the second end of the recess 13. The apparatus 1 shown also has electrical components such as an electrical power source 15 (such as a rechargeable or non-rechargeable battery), a controller 16 and an actuator 17 for enabling user activation of the heater 21.

Figure 8:
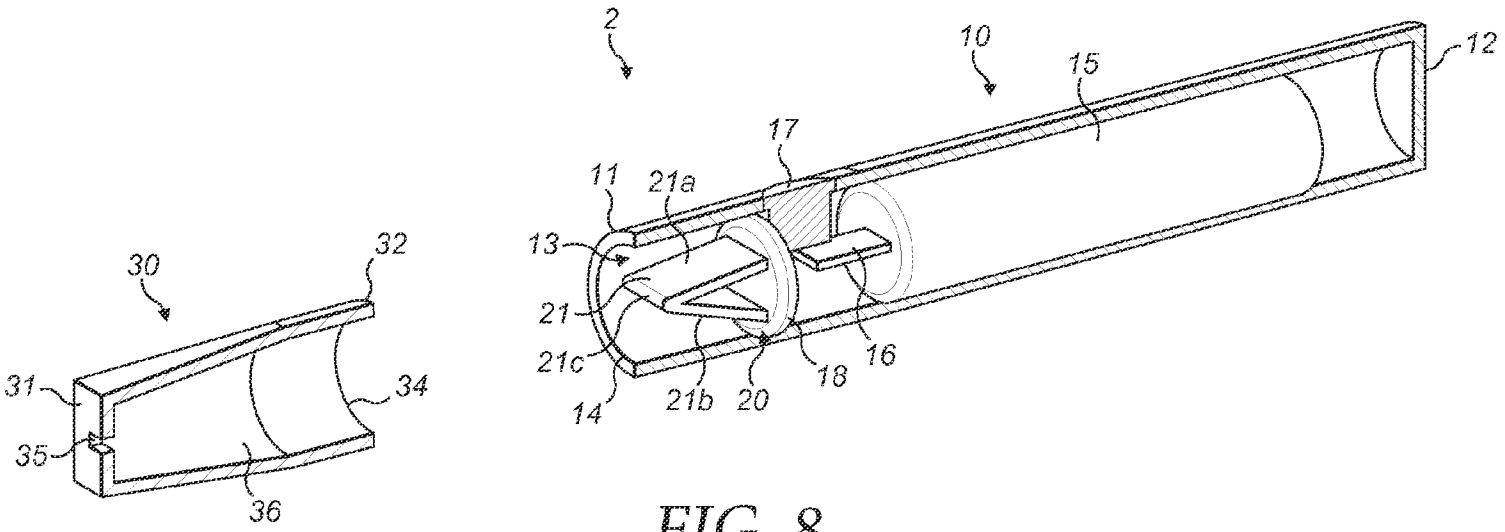
FIG. 8 shows a partially cut-away perspective view of an example of another apparatus for heating smokable material to volatilize at least one component of the smokable material.

Referring to FIG. 8, there is shown an example of an apparatus 2 suitable for use with a cartridge 70, 90 as described above with reference to FIGS. 4 and 6 respectively for heating smokable material to volatilize at least one component of the smokable material. The apparatus 2 may be operated in much the same way as the apparatus 1 of FIG. 7. Like elements in FIGS. 7 and 8 are indicated with like reference numerals. In the example shown the heating device 20 has a wedge-shape heater 21 which projects into the recess 13. The wedge-shape heater 21 can be inserted into the cavity 67 of the cartridges 70, 90 to heat the carrier 61, 51. In an embodiment, the wedge-shape heater 21 fits snugly in the cavity 67 for efficient heat transfer to the carrier 61, 51 and the smokable material 52, 62.

In this embodiment, the heater 21 is a folded heater 21 comprising a first heater portion 21*a* and a second heater portion 21*b*. The heater 21 has a fold 21*c* therein, and the first heater portion 21*a* is connected to the second heater portion 21*b* at the fold 21*c*. The fold 21*c* forms a distal end of the heater 21, which distal end is distal from the retainer 18. The first heater portion 21*a* defines an upper surface of the heater 21, and the second heater portion 21*b* defines a lower surface of the heater 21. In this embodiment, the first and second heater portions 21*a*, 21*b* lie substantially in respective first and second planes, and the first and second planes meet at an acute angle.

Figure 9:
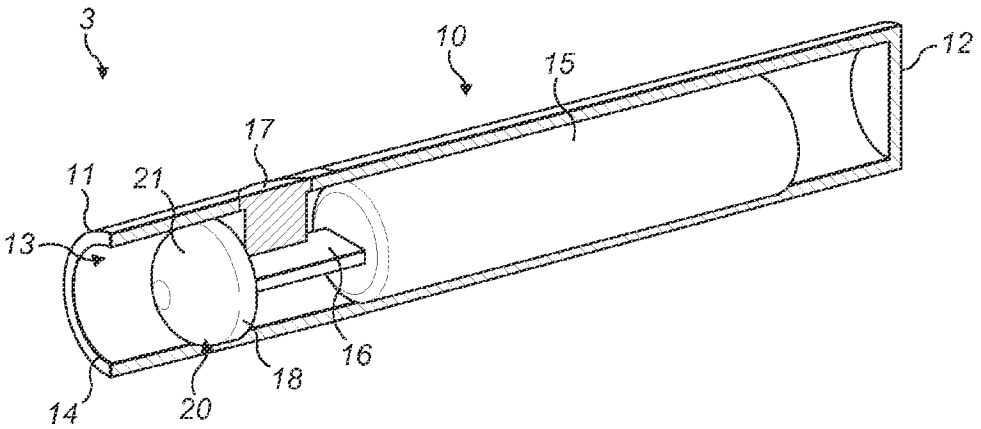
FIG. 9 shows a partially cut-away perspective view of an example of another apparatus for heating smokable material to volatilize at least one component of the smokable material.
Figure 9:
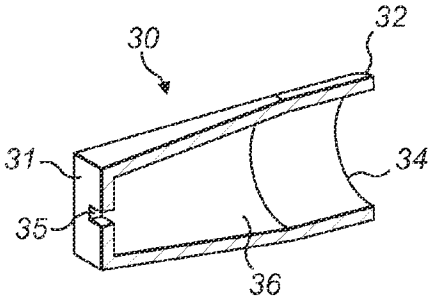

Referring to FIG. 9, an example of an apparatus 3 suitable for use with a cartridge 80 as described above with reference to FIG. 5 for heating smokable material to volatilize at least one component of the smokable material is shown. The apparatus 3 may be operated in much the same way as the apparatus 1, 2 of FIGS. 7 and 8. Like elements in FIGS. 7, 8 and 9 are indicated with like reference numerals. The heater 21 is for insertion into the cavity 67 of the cartridge 80 shown in FIG. 5. The heater 21 has an external dome-shaped surface profile that matches, or closely matches, the dome-shaped surface profile of the cavity 67 of the cartridge 80. Therefore, when the heater 21 is located in the cavity 67, the heater 21 is a close fit with the carrier 61. This helps provide good conduction of heat from the heater 21 to the carrier 61 and the smokable material 62 thereon. In this embodiment, the external dome-shaped surface profile of the heater 21 comprises a surface that is a combination of curved and polygonal portions. However, in other embodiments, the external dome-shaped surface profile may be defined by a surface of the heater 21 that is only polygonal or only curved.

In order to address various issues and advance the art, the entirety of this disclosure shows by way of illustration and example various embodiments in which the claimed invention may be practiced and which provide for a superior article or a superior cartridge for use with apparatus for heating smokable material to volatilize at least one component of the smokable material. The advantages and features of the disclosure are of a representative sample of embodiments only, and are not exhaustive and/or exclusive. They are presented only to assist in understanding and teach the claimed and otherwise disclosed features. It is to be understood that advantages, embodiments, examples, functions, features, structures and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist in essence of, various combinations of the disclosed elements, components, features, parts, steps, means, etc. The disclosure may include other inventions not presently claimed, but which may be claimed in future.

The invention claimed is:

1. A cartridge for use with apparatus for heating smokable material to volatilize at least one component of the smokable material, the cartridge comprising:

a housing defining a chamber, an article for use with apparatus for heating smokable material to volatilize at least one component of the smokable material, the article located within the chamber, the article comprising a pouch, the pouch comprising a carrier and smokable material arranged on the carrier, wherein the smokable material comprises a first layer of smokable material and a second layer of smokable material, wherein the first layer of smokable material is located between the carrier and the second layer of smokable material, and wherein the smokable material of the first layer of smokable material has a form or chemical composition that differs from a form of chemical composition, respectively, of the smokable material of the second layer of smokable material.

2. A cartridge according to claim 1, wherein the carrier defines part of an exterior surface of the cartridge, and wherein the smokable material is located within the chamber.

3. A cartridge according to claim 1, wherein the exterior surface of the cartridge comprises a cavity for receiving a heater for heating the smokable material, and wherein the carrier defines at least part of the cavity.

4. A cartridge according to claim 3, wherein the cavity has a mouth and a longitudinal axis, and wherein a cross-sectional size of the cavity perpendicular to the longitudinal axis decreases with distance from the mouth over at least a majority of a length of the cavity.

5. A cartridge according to claim 3, wherein the cavity is a wedge-shaped cavity or a dome-shaped cavity.

6. A cartridge for use with apparatus for heating smokable material to volatilize at least one component of the smokable material, the cartridge comprising:

a housing defining a chamber, an article for use with apparatus for heating smokable material to volatilize at least one component of the smokable material, the article located within the chamber, the article comprising a carrier and smokable material arranged on the carrier, wherein an air gap is defined between the housing and the smokable material, wherein the smokable material comprises a first layer of smokable material and a second layer of smokable material, wherein the first layer of smokable material is located between the carrier and the second layer of smokable material, and wherein the smokable material of the first layer of smokable material has a form or chemical composition that differs from a form of chemical composition, respectively, of the smokable material of the second layer of smokable material.

* * * * *